US010030923B1

(12) United States Patent
Loveday, IV et al.

(10) Patent No.: US 10,030,923 B1
(45) Date of Patent: Jul. 24, 2018

(54) AMMUNITION MAGAZINE

(71) Applicant: Elite Tactical Systems Group, LLC, Cheyenne, WY (US)

(72) Inventors: George E. Loveday, IV, Knoxville, TN (US); George E. Loveday, III, Knoxville, TN (US)

(73) Assignee: Elite Tactical Systems Group, LLC, Cheyenne, WY (US)

( * ) Notice: Subject to any disclaimer, the term of this patent is extended or adjusted under 35 U.S.C. 154(b) by 283 days.

(21) Appl. No.: 14/752,160

(22) Filed: Jun. 26, 2015

Related U.S. Application Data

(63) Continuation-in-part of application No. 14/527,767, filed on Oct. 29, 2014.

(60) Provisional application No. 61/962,018, filed on Oct. 29, 2013.

(51) Int. Cl.
*F41A 9/65* (2006.01)
*F41A 9/70* (2006.01)

(52) U.S. Cl.
CPC .. *F41A 9/70* (2013.01); *F41A 9/65* (2013.01)

(58) Field of Classification Search
CPC ..... F41A 9/68
USPC ..... 42/50
See application file for complete search history.

(56) References Cited

U.S. PATENT DOCUMENTS 4,484,403 A * 11/1984 Schwaller ..... B65D 21/0204 42/50
2016/0123687 A1* 5/2016 Cook, Jr. ..... F41H 3/00 42/50

OTHER PUBLICATIONS

Internet Article: Swiss Arms rifle magazines 30(5); Aug. 22, 2009; http://www.canadiangunnutz.com/forum/showthread.php/378284-Swiss-Arms-rifle-magazines-30(5)-39-99-FREE-SHIPPING.*

* cited by examiner

*Primary Examiner* — Reginald Tillman, Jr.
(74) *Attorney, Agent, or Firm* — J. Kenneth Hoffmeister

(57) ABSTRACT

Aspects of a magazine for use with a repeating firearm are described. One unique aspect is that the magazine is fabricated completely from a translucent polymer, particularly a polyphenylsulfone (PPSU) and, preferably, an unreinforced PPSU that is highly resistant to mechanical, chemical, and thermal failures commonly affecting magazines. Another aspect of the magazine is the inclusion of a coupling system fully integrated into the housing that allows magazines to be securely joined together without the use of tools or additional components. A further aspect of the magazine is the easy release button design allowing the magazine to be disassembled by large or gloved fingers without need for a tool to depress the release button.

25 Claims, 11 Drawing Sheets

AMMUNITION MAGAZINE

CROSS-REFERENCE TO RELATED APPLICATIONS

This application is a continuation-in-part of U.S. application Ser. No. 14/527,767 filed Oct. 29, 2014, which claims the benefit of U.S. Provisional Application 61/962,018 filed Oct. 29, 2013.

BACKGROUND

Conventional modern firearm components and magazines are generally fabricated from metals (e.g., steels or aluminums) or from thermoplastic polymer composites reinforced with other materials to meet specific performance requirements not obtainable from the thermoplastic polymers, such as polypropylene (PP) and nylon. One class of thermoplastic polymer composites commonly used in firearm components and magazines is long-fiber reinforced thermoplastics (LFTs). LFTs are thermoplastic polymers reinforced with long glass or carbon fibers, or a combination thereof. Thermoplastic polymers may also be reinforced with other materials, such as steel.

Still other firearm components and magazines are fabricated from or incorporate polycarbonate (PC) or polyether ether ketone (PEEK), which may be used without reinforcement. Polycarbonate and PEEK magazines may be made in various colors and with various levels of opacity, which may reduce or eliminate the need for a magazine level indicator allowing visual inspection of the number of rounds held by the magazine. However, use of polycarbonates and PEEK to provide opacity comes at the cost of reduced creep and chemical resistance when compared to other materials, such as LFTs. As a result, PEEK magazines exhibit feed lip deformation that eventually result in ammunition retention and feed problems when stored loaded with ammunition for extended periods of time. To compensate for creep, some conventional PEEK magazines incorporate other materials, such as steel, into the feed lips.

Due to the undesirable characteristics associated with translucent materials, some conventional magazines have bodies made from LFTs, or other more durable materials, and utilize windows made from polycarbonate or PEEK to cover the magazine level indicator openings rather than compromise quality by using PC or PEEK to produce a translucent magazine. Left uncovered, magazine level indicator openings provide intrusion points for contaminants, such as dirt, oil, water, chemicals, etc., which may degrade the internal components (e.g., the spring) of the magazine or interfere with the operation of the magazine (e.g., cause binding).

It is with respect to these and other considerations that the present invention has been made.

BRIEF SUMMARY

Briefly described, this invention provides an improved ammunition magazine having a magazine coupling system without additional external components. The coupling system is bi-directional ambidextrous and can be engaged or disengaged in a very short time (e.g., one second).

The coupling system is self-aligning, requires no tools to engage or disengage, and is rotational in that the coupling system rotates around a center axis.

The coupling system features two stabilizers which limit movement of coupled magazines in multiple axes and has preload ramps built in.

The coupling system includes a lock which is a self-adjusting, rotational, ¼ turn locking mechanism having an alignment ring that interfaces with the semi-round collar with undercuts that capture the dual finger interface that extends from the center shaft.

The quick disassembly/re-assembly system has a floor plate, floor plate insert and a housing geometry that aid the user in disassembling and re-assembling the ammunition magazine during maintenance, without the use tools.

The floor plate features a bullet shaped slot that matches the bullet shaped tab on the floor insert. This slot also features an angled relief on three sides that allow the user to easily depress the floor insert with only a finger to remove the floor plate to disassemble the magazine.

The housing features internal ribs, similar to current polymer magazines; however, the internal ribs of this invention cease near the bottom of the housing. These ribs limit the depth of travel into the housing, thus correctly positioning the floor insert for assembly.

The magazine features a debris cover that greatly reduces the amount of dust, dirt, and other debris that can enter while the magazine is being stored.

The debris cover features an improved clip design consisting of two clips on either side of the back ridge. These clips are easily spread and disengaged when the thumb is moved vertically along the back ridge making the debris cover easily removable with one hand.

The housing features grip ribs on the lower half of the magazine that greatly enhances the users grip due to the sharp angled relief in the center of the rib. The sharp edges in these grip ribs are positioned in the center of the rib to prevent the edges from catching on magazine pouches and other types of storage devices.

At least the body of the magazine and other firearm components are fabricated from a polyphenylsulfone (PPSU). The present inventors have determined that PPSU has properties that make it surprisingly suitable for producing firearm components. Testing has shown that PPSU has good flexibility, excellent chemical resistance, excellent resistance to creep, and good environmental performance over a wide range of temperatures and humidities that provides superior resistance to the mechanical, chemical, and thermal failures commonly affecting conventional polymer firearm components. Aspects include fabrication of the body of a magazine, other magazine components, or other firearm components using an unreinforced PPSU. One suitable brand of PPSU for manufacturing firearm components is, without limitation, Ultrason® P 3010 manufactured by BASF Corporation.

BRIEF DESCRIPTION OF THE DRAWINGS

Further features, aspects, and advantages of the present disclosure will become better understood by reference to the following figures, wherein elements are not to scale so as to more clearly show the details and wherein like reference numbers indicate like elements throughout the several views.

DETAILED DESCRIPTION

Figure 1:
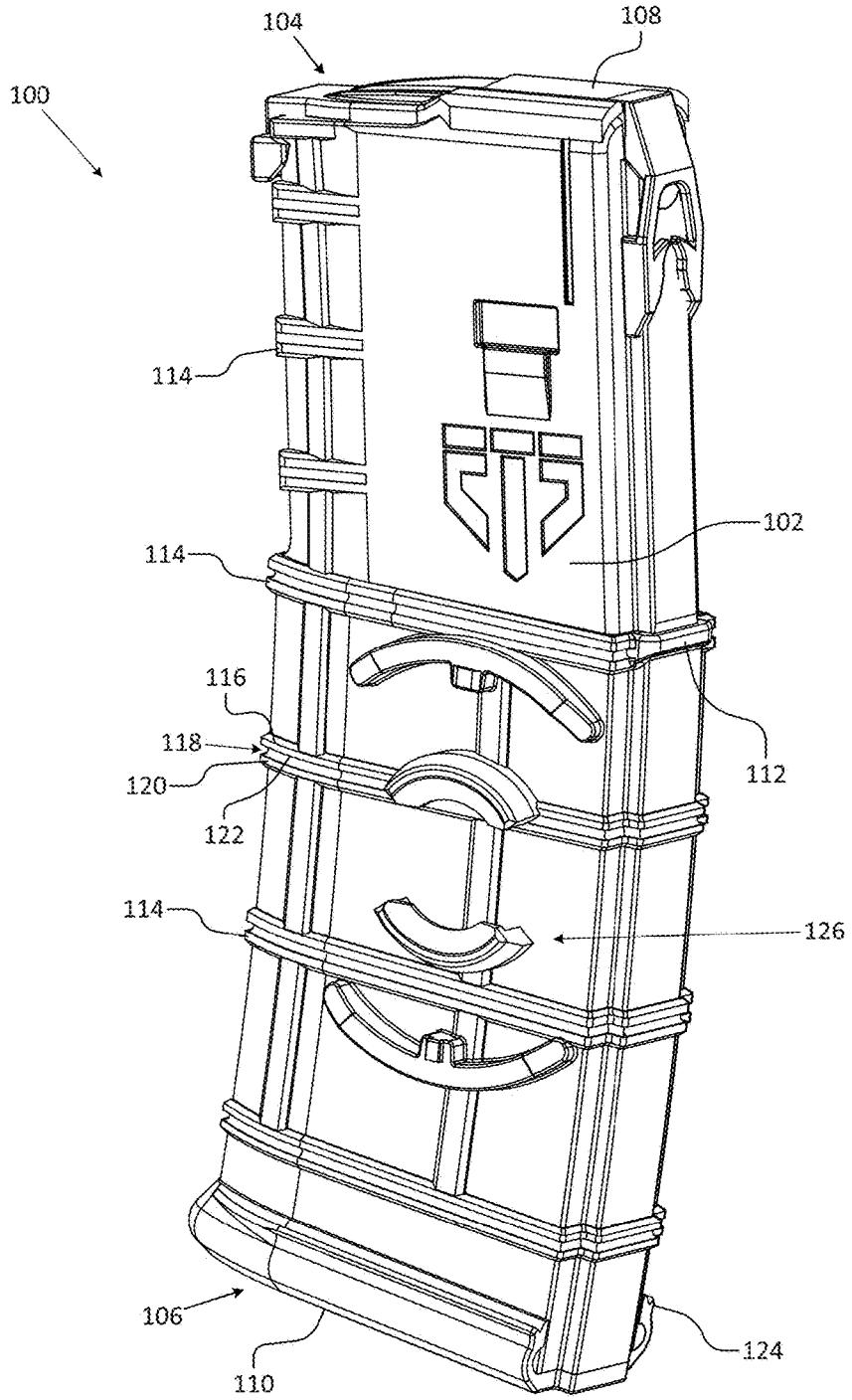
FIG. 1 is a perspective view illustrating aspects of the present invention embodied in a detachable box magazine for a magazine fed firearm.

Aspects of a magazine and other components of or for use with a repeating firearm are described herein and illustrated in the accompanying figures. At least the body of the magazine and other firearm components are fabricated from a polyphenylsulfone (PPSU). The present inventors have determined that PPSU has properties that make it surprisingly suitable for producing firearm components. Testing has shown that PPSU has good flexibility, excellent chemical resistance, excellent resistance to creep, and good environmental performance over a wide range of temperatures and humidities that provides superior resistance to the mechanical, chemical, and thermal failures commonly affecting conventional polymer firearm components. Aspects include fabrication of the body of a magazine, other magazine components, or other firearm components using an unreinforced PPSU. One suitable brand of PPSU for manufacturing firearm components is, without limitation, Ultrason® P 3010 manufactured by BASF Corporation.

Those skilled in the art may recognize the firearm component depicted in FIGS. 1 through 8 as a detachable box magazine usable with the many variants of the M4/M16/AR15 rifle platform and other rifles with compatible magazine wells and is hereinafter referred to as an "AR magazine." The AR magazine offers a particularly good example to discuss the advantages of PPSU for firearm components because it is widely used in both military and civilian applications and must meet more demanding requirements than most any other magazine or firearm components. For example, AR magazines have strict dimensional tolerances that must be observed in order to fit within the magazine well and properly feed ammunition. In particular, the dimensional restrictions of AR magazines makes producing a polymer magazine that is not susceptible to mechanical failure a challenging endeavor. More specifically, the dimensional restrictions effectively preclude the magazine walls and feed lips from having sufficient thickness to handle instantaneous stresses (e.g., impacts when a loaded magazine is dropped) and long-term stresses (e.g., long term storage under load).

Use of PPSU when fabricating firearm components is not entirely without drawbacks, such as the high cost of PPSU and greater flex (especially when dealing with unreinforced or translucent PPSU) in comparison to long-fiber reinforced thermoplastics (LFT's), polypropylenes, (PP), polycarbonates (PC), and other thermoplastics commonly used to fabricate synthetic components of and for modern firearms. Despite these drawbacks, the present inventors have determined that the advantages of using PPSU outweigh the disadvantages when fabricating firearm components. Even still, designing a transparent magazine fabricated from PPSU that was also reliable was not a straight-forward process. As described herein, one cannot simply select any of the time-tested magazine designs that are suitable for aluminum and reinforced, non-translucent polymer magazines and expect to produce a durable and reliable PPSU magazine. The present inventors have invested considerable time and resources to identify a polymer that is suitable for producing a translucent polymer magazine and to design and test translucent polymer magazines that meet or exceed the performance standards of the top conventional magazines without accepting the, often significant, compromises in quality, durability, and/or reliability that has plagued conventional see-through magazines.

FIG. 1 is a perspective view illustrating aspects of the present invention embodied in a magazine for a magazine fed firearm. The magazine 100 includes a housing 102 having a feed end 104 and a floor end 106. The entire magazine housing (body) 102, including the feed lips, is fabricated from a homogeneous PPSU. In other words, the magazine is not a hybrid of PPSU and a secondary material, such as a PPSU body with steel feed lips. The magazine 100 is configured to hold ammunition used by the firearm. The upper portion of the housing 102 proximate to the feed end 104 is configured for insertion into the magazine well of the firearm. The feed end 104 interfaces with the firearm to guide ammunition cartridges into the firing chamber. In the illustrated embodiment, the feed end 104 is closed by an optional removable cover 108, and the floor end 106 is closed by a removable floor plate 110. Some embodiments include a limit tab 112 that prevents users from inserting the magazine 100 too far into the magazine well (i.e., over-insertion).

Aspects of the magazine 100 include a series of external ribs 114. The ribs 114 run substantially transverse to the direction of the force that is applied to insert the magazine 100 into or remove the magazine 100 from the magazine well of a firearm or a pocket, belt pouch, or other carrier. Typically, the ribs 114 are transverse to the long axis of the magazine 100 (i.e., substantially horizontal). The ribs 114 disrupt the generally smooth outer surface of the housing 102 and form raised features that reduces or eliminates slippage of the magazine 100 in a user's hand when then the user is gripping the magazine 100, especially when pushing or pulling on the magazine 100.

Depending upon location, each rib 114 may extend fully or partially across one or more faces of the housing 102. In the illustrated embodiment, for example, each rib 114 on the upper portion of the magazine 100 that fits into the magazine well is a small segment extending partially across the side face of the housing 102. However, the ribs 114 on the portion of the housing that is not inserted into the magazine well extended around the majority of the housing perimeter.

The outer edges 116 of the ribs 114 need not be sharp, angular corners. Instead, the outer edges 116 of the ribs 114 are slightly rounded or chamfered to minimize the likelihood that the ribs 114 will catch when the magazine 100 is being inserted into or removed from an object, such as and without limitation, a pocket or magazine pouch. To improve grip, each rib 114 features a central axial channel, or relief, 118. The top face 120 of the rib 114 on either side of the channel 118 is substantially flat. The upper edges 122 of the ribs 114 bounding the channel 118 define sharper, angular corners (i.e., not substantially rounded) that allow for superior grip on the magazine. When a pliable surface, such as a user's skin or glove, grips one of the ribs, the grip pressure is applied to the top faces and distributed over the rib 114 and the squeezes the skin or glove down into the channel 118 where the channel edges 122 catch the skin or glove, which results in greater friction at the interface. In the absence of gripping forces applied to the rib, the inner edges are protected. In the presence of the lateral forces encountered as the magazine 100 slides past another object with minimal downward pressure, the flat top faces of the ribs 114 guide objects over the channel so the inner edges do not catch on the object. Further, when being gripped, the rounded outer edges and flat top faces of the ribs 114 distribute the downward grip pressure and do not cut into a user's skin minimizing any discomfort a user might feel from the ribs 114 when pushing or pulling the magazine 100. An enlargement of some features of the ribs 114 appears in the inset of FIG. 4B.

Figure 2:
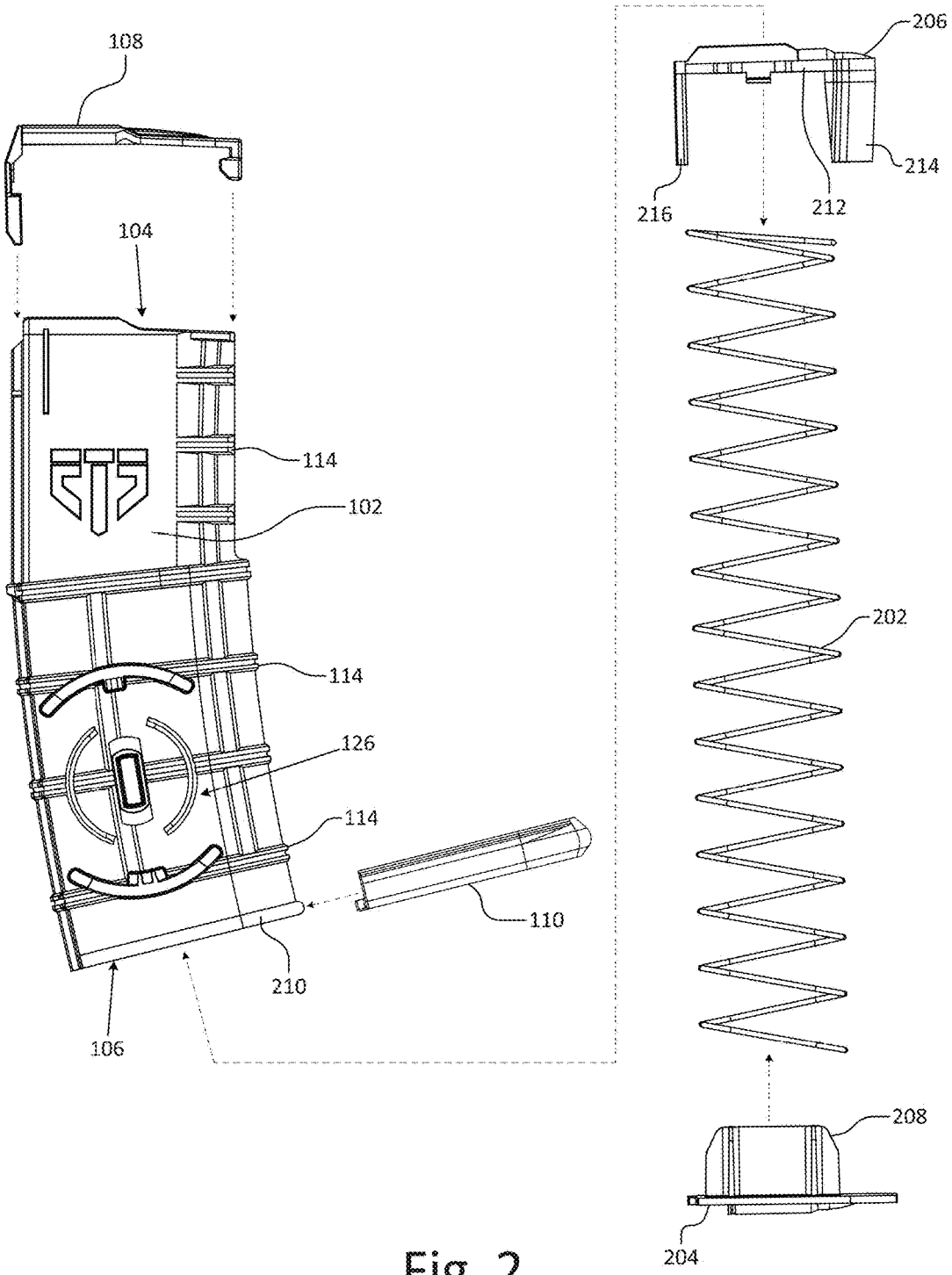
FIG. 2 is an exploded assembly drawing illustrating aspects of the magazine depicted in FIG. 1.

Because magazines 100 are typically stored upside down in magazine pouches and the only the floor plate 110 and, perhaps, a limited portion of the floor end 106 of the housing 102 are exposed, various embodiments of the floor plate 110 optionally feature a rib 124 that provides better grip when pulling on the floor plate 110 of the magazine 100. Additionally, a portion of an optional magazine coupling system 126 integrated into the housing 102 is visible in the illustrated embodiment FIG. 2 is an exploded view of the magazine for a magazine fed firearm depicted in FIG. 1. Internally, the magazine 100 includes a spring 202 with a floor insert 204 clipped to one end and a follower 206 clipped to the other end. The spring 202 is pushed over the floor insert spring guide 208 and is then attached to the spring clips of the floor insert 204. A floor plate 110 slides along a rail 210 that is proximate and substantially parallel to the bottom edge of the housing 102. When installed, the floor plate 110 is locked into place by the floor insert 204 under pressure from the spring 202.

In use, the spring 202 pushes the follower 206 upward through the housing 102 as ammunition is fed into the firearm. The follower 206 includes a shelf 212, a front leg 214, and, optionally, a rear leg 216. The shelf 212 is the platform that directly supports the ammunition cartridges. The front leg 214 operates as part of a follower stabilization system that reduces or eliminates axial tilt experienced by the follower 206.

The optional rear leg 216 serves as a spring guide. In some implementations, the capacity of the magazine 100 may be mechanically limited (i.e., pinned) to comply with legal restrictions. For example, a rivet may be installed through the rear side of the housing 102 to limit travel of the follower 206 and reduce usable portion of the magazine 100. When limited to small capacities (e.g., 10 rounds), the ammunition cartridges only occupy the upper portion of the magazine 100. Due to the tight clearances, the rivet cannot be installed in the portion of the magazine 100 that is inserted into the magazine well of the firearm. Accordingly, the rivet is generally installed in the lower portion of housing 102 (e.g., just below the limit tab 112). However, if the follower 206 were permitted to travel until the shelf 212 reaches the rivet, the magazine 102 would not comply with the capacity restriction. Instead, the rear leg 216 serves as a stop that extends below the follower 206 to engage the rivet while the shelf 212 remains at or above the minimum level to properly limit the capacity of the magazine 100.

Figure 3:
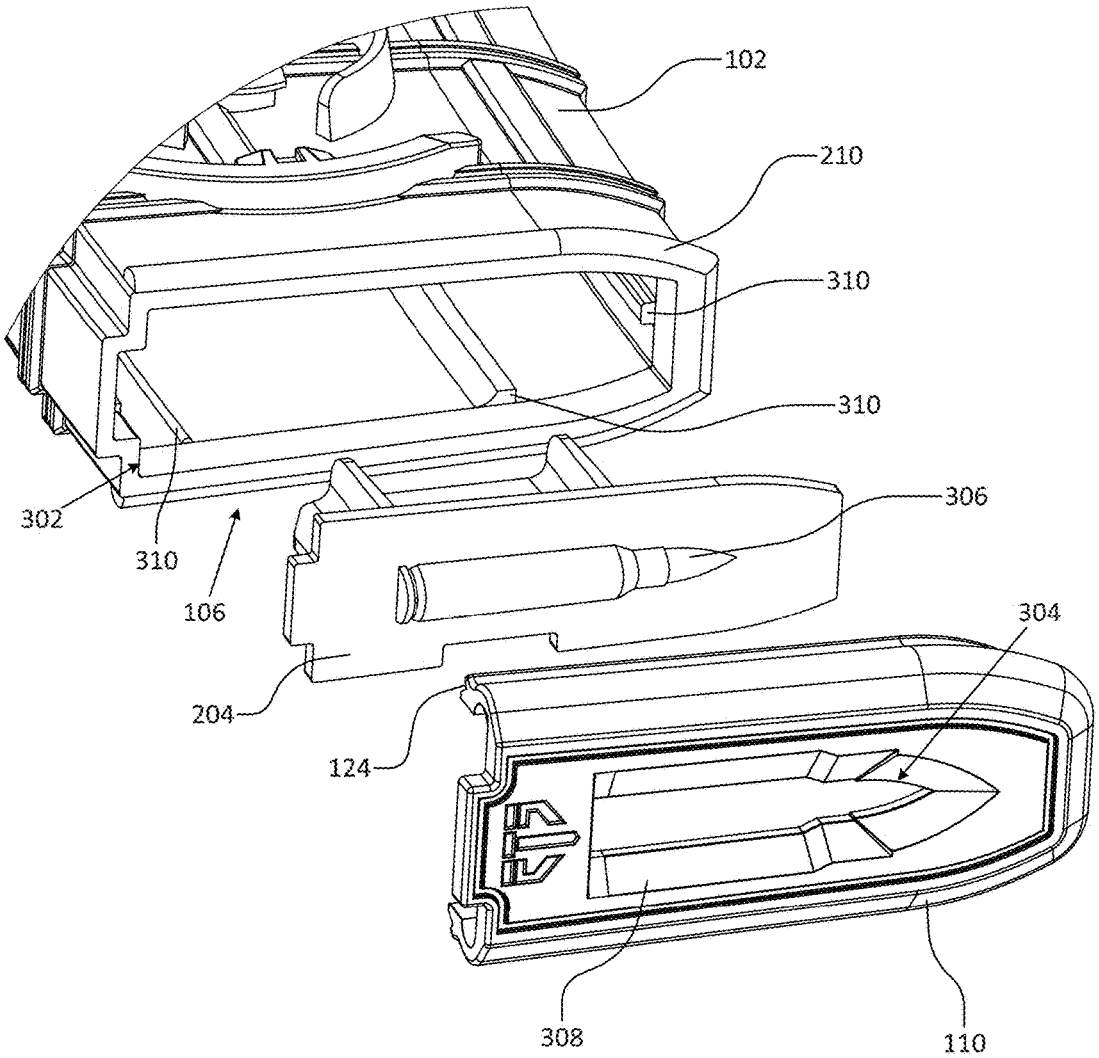
FIG. 3 is an exploded perspective view of the bottom portion of the magazine illustrating aspects of the floor plate release mechanism.

FIG. 3 is an exploded perspective view of the floor end assembly of the magazine depicted in FIG. 1. The installation and removal of the floor plate 106 allows the magazine 100 to be assembled and disassembled. Once installed, the floor plate 106 covers the floor end opening 302 defined by the housing 102 and provides the necessary support for the spring 202 to bias the follower 206 toward the feed end 104 of the housing 102. Removing the floor plate 106 allows the magazine 100 to be disassembled, for example, to maintain or clean the magazine 100.

The floor insert 204 include a tab 304 that is configured to be received by a corresponding slot 306 defined by the floor plate 106. In the illustrated embodiment, the tab 304 and the slot 306 are shaped like a bullet. The tab 304 is received in the slot 306 and held in place by compression applied by the spring 202. The interface between the tab 304 and the slot 306 prevents the floor plate 106 from sliding along the rail 210. The floor plate 106 remains securely attached to the housing 102 until the tab 304 is dislodged from the slot 304, for example, by pushing the tab 306 inward.

The dimensions of the slot 304 and tab 306 in conventional magazines are matched to provide a positive engagement that minimizes play. Further, conventional magazine floor plates are relatively thick, which further makes dislodging the tab 306 more difficult using one's fingers. For users that commonly wear gloves (e.g., hunters, law enforcement, or military personnel), disassembling a magazine can be problematic. However, gloves are not the only source of problems. Large fingers and certain conditions (e.g., arthritis) may also hinder the ability to push the tab 306. As a result, it is not uncommon for users to make use of tools (e.g., an ammunition cartridge, a screwdriver, or a rock) to free the tab 306 from the slot 304. At the very least, it is inconvenient for users to remove gloves or locate a tool just to disassemble a magazine.

In various embodiments, the external face of the floor plate 106 optionally defines a relief or depression 308 around at least a portion of the slot 304 to facilitate operative access to the tab 306. The illustrated embodiment shows an angled relief 308 made around three sides of the slot 304. The relief 308 allows the user to easily depress the tab 306 with a finger to disassemble the magazine 100, even while wearing gloves and without resorting to tools.

The interior of the housing 102 may include one or more internal ribs 310 that terminate before reaching the floor end 106 of the housing 102. The internal ribs 310 limit the depth that the floor insert 204 may travel into the housing 102. Limiting travel of the floor insert 204 facilitates re-assembly the magazine 100 by holding the floor insert 204 in the correct position.

FIGS. 4A-D are left side elevation, right side elevation, front elevation, and rear elevation views, respectively, illustrating aspects of the housing of the magazine depicted in FIG. 1. The feed end 104 defines a feed opening 402 and the feed lips 404 that captures the cartridges being pushed toward the feed opening 402 by the spring 202 and holds them in place.

Figure 5:
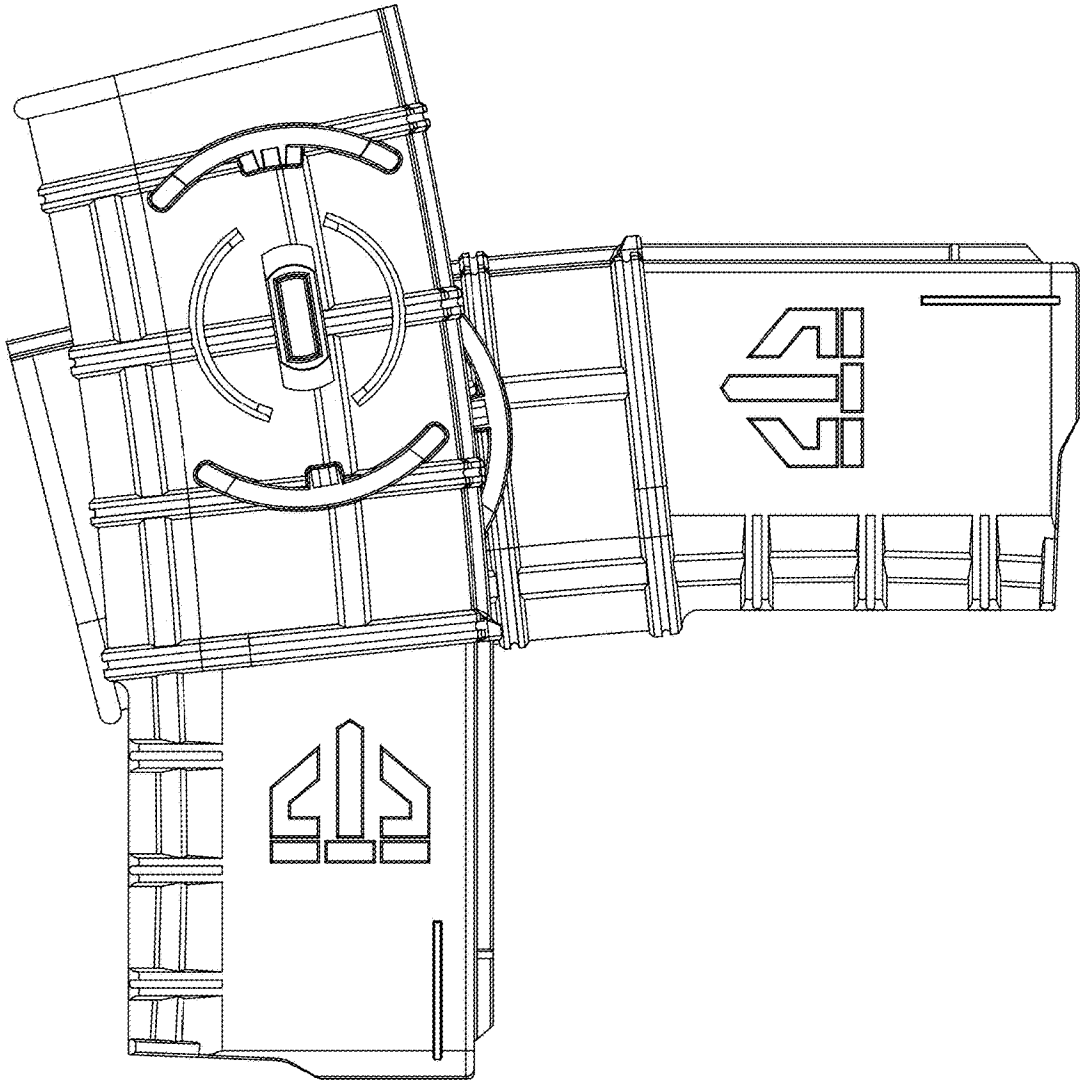
FIG. 5 illustrates an example of two magazines in a mated, but uncoupled state.
Figure 6:
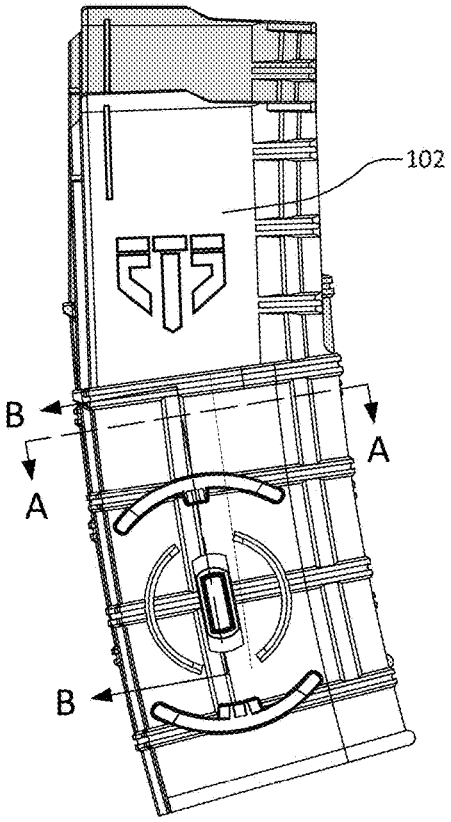
FIG. 6 illustrates two magazines coupled together using an embodiment of the coupler described herein.
Figure 7:
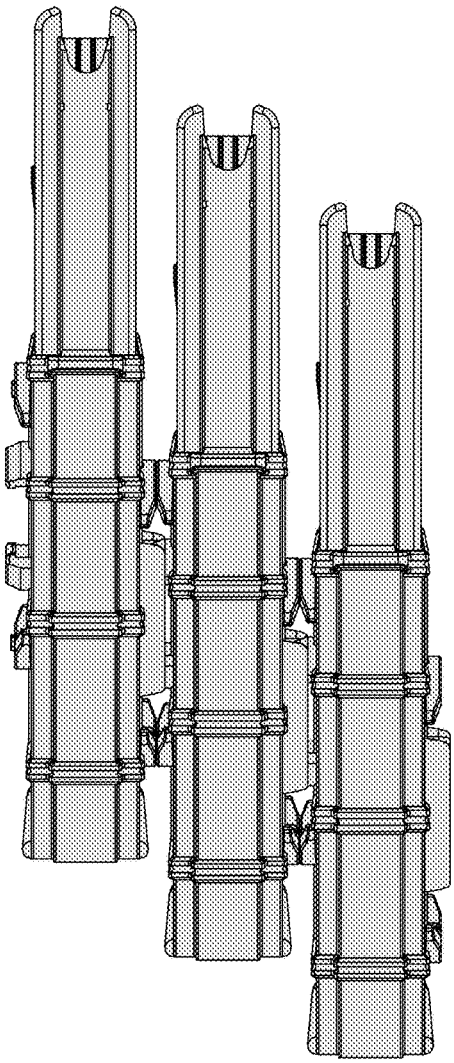
FIG. 7 is front elevation view of three connected housings joined using an embodiment of the coupler described herein.

Another aspect of the magazine 100 is the optional magazine coupling system. Structural details of one embodiment of the magazine coupling system are depicted in FIGS. 4A-D. FIGS. 5 through 7 illustrate additional aspects of the construction and operation of the embodiment of the magazine coupling system.

Aspects of the magazine 100 include a magazine coupling system 126 with a two-part coupler that is completely integrated into the housing 102 and allows magazines 100 to be securely connected to other magazines 100. The magazine coupling system 126 is ambidextrous. The magazine coupling system 126 facilitates faster magazine changes when all of the cartridges have been fired. The magazine coupling system 126 is ambidextrous and can be engaged or disengaged very quickly using one hand (e.g., in less than one second).

The coupler 126 includes a first fastener 406 integrated on one side (e.g., the left side) of the housing 102 and a second fastener 408 integrated on the opposite side (e.g., the right side) of the housing 102. The first fastener 406 and the second fastener 408 are configured to be selectively operatively engaged to securely couple two magazines 100 together and operatively disengaged to separate the two magazines 100. Magazines with the integrated coupler may be securely connected exclusively by manual manipulation (i.e., by hand). No additional components are or tools are needed couple the magazines 100 together.

In one implementation of the coupler, the first fastener 406 and the second fastener 408 are configured to rotate relative to one another about a central axis. The configurations of the first fastener 406 and the second fastener 408 define a mating position and a locked position for the second fastener 408 relative to the first fastener 406. The first fastener 406 and the second fastener 408 may be joined (i.e., mated) and separated (i.e., unmated) in when the mating position.

FIG. 5 illustrates an example of two magazines in a mated, but uncoupled state. In the illustrated embodiment, the first fastener 406 and the second fastener 408 are configured to be in the mating position when the two magazines 100 are oriented substantially orthogonal to one another. However, the first fastener 406 and the second fastener 408 may be configured such that the mating position occurs at another relative orientation of the two magazines. One the first fastener 406 and the second fastener 408 are mated, the magazines 100 are rotated into the locked position. Embodiments of the magazine coupling system feature bidirectional engagement allowing rotation in either direction to cause the magazines to be coupled.

Figure 6A:
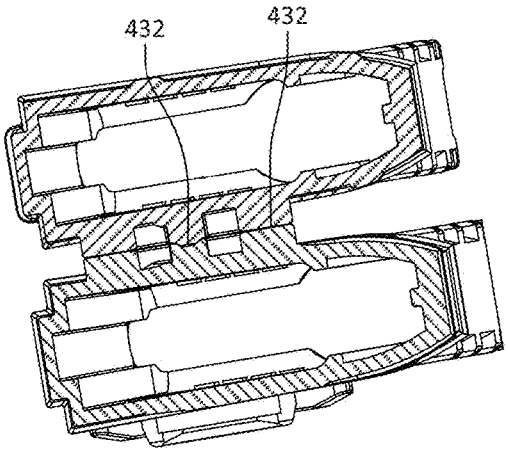
FIG. 6A is a sectional plan view taken along section A-A of FIG. 6 illustrating the interface between the first fastener and the second fastener.
Figure 6B:
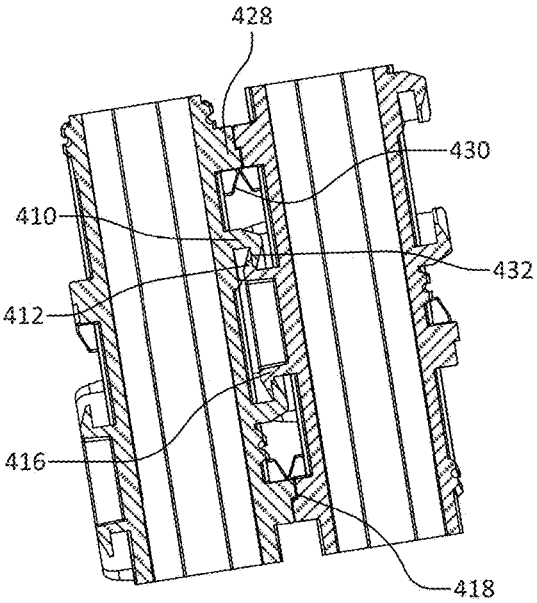
FIG. 6B is a sectional side elevation view taken along section B-B of FIG. 6 illustrating the interface between the first fastener and the second fastener.

FIGS. 6, 6A, and 6B illustrate aspects of the two magazines securely coupled together using an embodiment of the coupler described herein. FIG. 7 illustrates three magazines joined using an embodiment of the coupler described herein. The illustrated embodiment of the locking mechanism is configured such that the major axes of the two magazines 100 are substantially parallel to one another when in the locked position. However, the magazine coupling system may be configured to allow users to couple magazines in a variety of different orientations. For example, some embodiments allow the magazines to be vertically aligned with the feed ends pointing in the same direction or in opposite directions. Other embodiments may allow magazines to be coupled orthogonally or at other angles (i.e., 0° to 360°). For example, an orthogonal orientation may allow coupled magazines to be utilized in firearms where arrangement of the firearm near the magazine well prevents vertically coupled magazines from be used.

In the illustrated implementation of the magazine coupling system 126, the first fastener 406 and the second fastener 408 are configured as pairs of arcuate flanges 410, 412. Each flange 410, 412 is substantially parallel to the corresponding face of the magazine and is supported by a riser 414, 416 projecting outwardly from the face of the corresponding side of the housing 102. The flanges 410 of the first fastener 406 extend inwardly toward the focal points of the corresponding arcs. The flanges 412 of the second fastener 408 extend outwardly away from the focal points of the corresponding arcs. The first fastener flanges 410 and the second fastener flanges 412 are configured to overlap when operatively engaged. Stated differently, the second fastener 408 includes a center shaft with two fingers that extend outward 180° apart, and the first fastener 406 is configured with two semi-circular collars having under cuts that capture the dual finger interface of the second fastener 408.

Each of the first fastener and the second fastener also include a lock mechanism. The lock member generally includes a first lock part integrated on one side (e.g., the left side) of the magazine 100 and a second fastener 408 integrated on the opposite side (e.g., the right side) of the housing 102. The coupler includes one or more detents or other lock mechanisms 418 that resist rotation of the magazines 100 when engaged. In various embodiments, the lock mechanism 418 features a broad tooth interlock design. For example, one of the opposing fasteners 406, 408 defines a recess 422 and the other fastener 406, 408 defines a lock tab 420. When the magazines are positioned in the locked position, the lock tab 420 is received in the recess 422 to keep the magazines from rotating and becoming uncoupled. In various implementations only one of the support ribs includes a lock mechanism 418. Squeezing the ends of the magazines opposite from the support ribs where the lock mechanism 418 is located lifts the lock tab 420 out of the recess 422 and allows the magazines 100 to be readily rotated and separated. Various implementations of the lock design optionally include a built in self-adjusting wear interface 424 (see FIG. 6B) so the locks will remain tight even as they wear.

Geometrically, with respect to the first fastener 406, the distance from the central point $c_1$ between the pair of arcs to the riser 414 defines the outer radius $r_{o1}$. The distance from the central point $c_1$ between the pair of flanges 410 and the front edge of the flange 410 defines the inner radius $r_{i1}$. With respect to the second fastener 408, the distance from the central point $c_2$ between the pair of arcs to the front edge of the flange 412 defines the outer radius $r_{o2}$. The distance from the central point between the pair of arcs to the riser 416 defines the inner radius $r_{i2}$. The outer radius $r_{o1}$ of the first fastener 406 is greater than the outer radius $r_{o2}$ of the second fastener 408. The inner radius $r_{i1}$ of the first fastener 406 is less than the outer radius $r_{o2}$ of the second fastener 408, but greater than the inner radius $r_{i2}$ of the second fastener 408.

The first fastener flanges 410 are separated from each other to create an area for receiving the second fastener 408. In the illustrated embodiment, the distance between the proximal ends of the separate first fastener flanges 410 defines the separation distance d. The second fastener flanges 412 have a width w that is defined by the secant connecting the ends of each second fastener flange 412. The width w of the second fastener flanges 412 is less than the separation distance d between the first fastener flanges 410.

The second fastener 408 optionally includes a guide 426 that facilitates proper alignment of the first fastener 406 with the second fastener 408 when mating. In some embodiments of the rotating coupler described herein, the guide is formed as a circular boundary wall or arcuate segments of the circular boundary wall having a radius greater than the outermost radius of the first fastener 406 (e.g., an outer semi-circular alignment ring).

Implementations of the coupler 126 also include one or more support ribs associated with each of the first fastener 406 and the second fastener 408. In the illustrated embodiment, both the first fastener 406 and the second fastener 408 include a top support rib 428 and a bottom support rib 428. However, the number and relative positions of support ribs may vary. The support ribs provide multi-axial stabilization to minimize or eliminate coupled magazines from wobbling in the vertical and horizontal axes. Additionally, the support ribs also provide preload 432 (see FIG. 6B) to bring the first flanges of the first fastener 406 into frictional engagement with the second fastener 408 (i.e., to provide a tight fit for the fingers when interfacing with the collars). The ramps 430 at the ends of support ribs 428 reduce the initial rotational force and cycle stress on the coupler 126 by slowly increasing the preload as the second fastener 408 is rotated relative to the first fastener 406 toward the locked position. In some implementations, the lock mechanisms 418 are integrated into the support ribs 428.

Figure 4A:
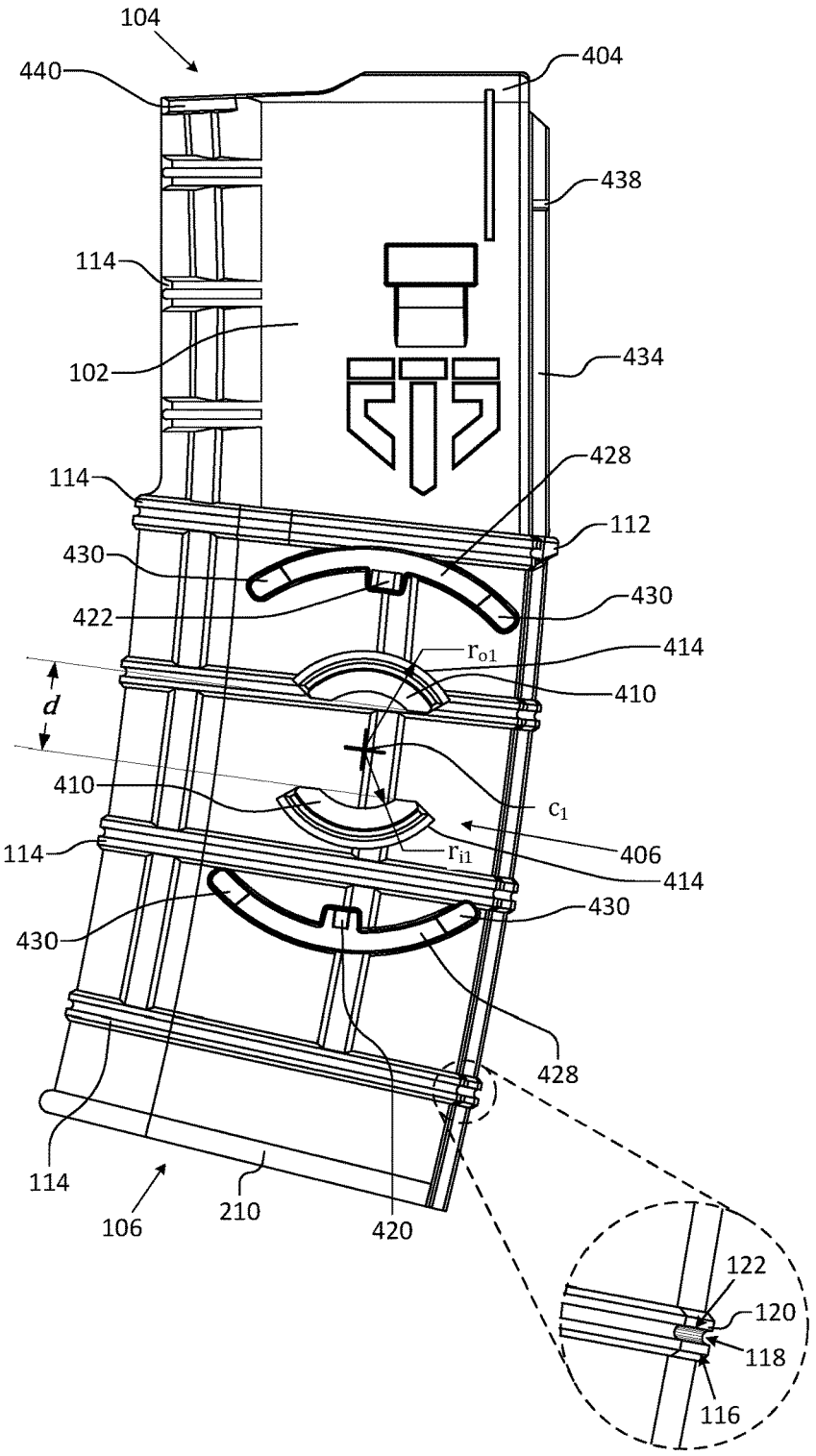
FIG. 4A is a left side elevation view illustrating aspects of the housing of the magazine depicted in FIG. 1.
Figure 4B:
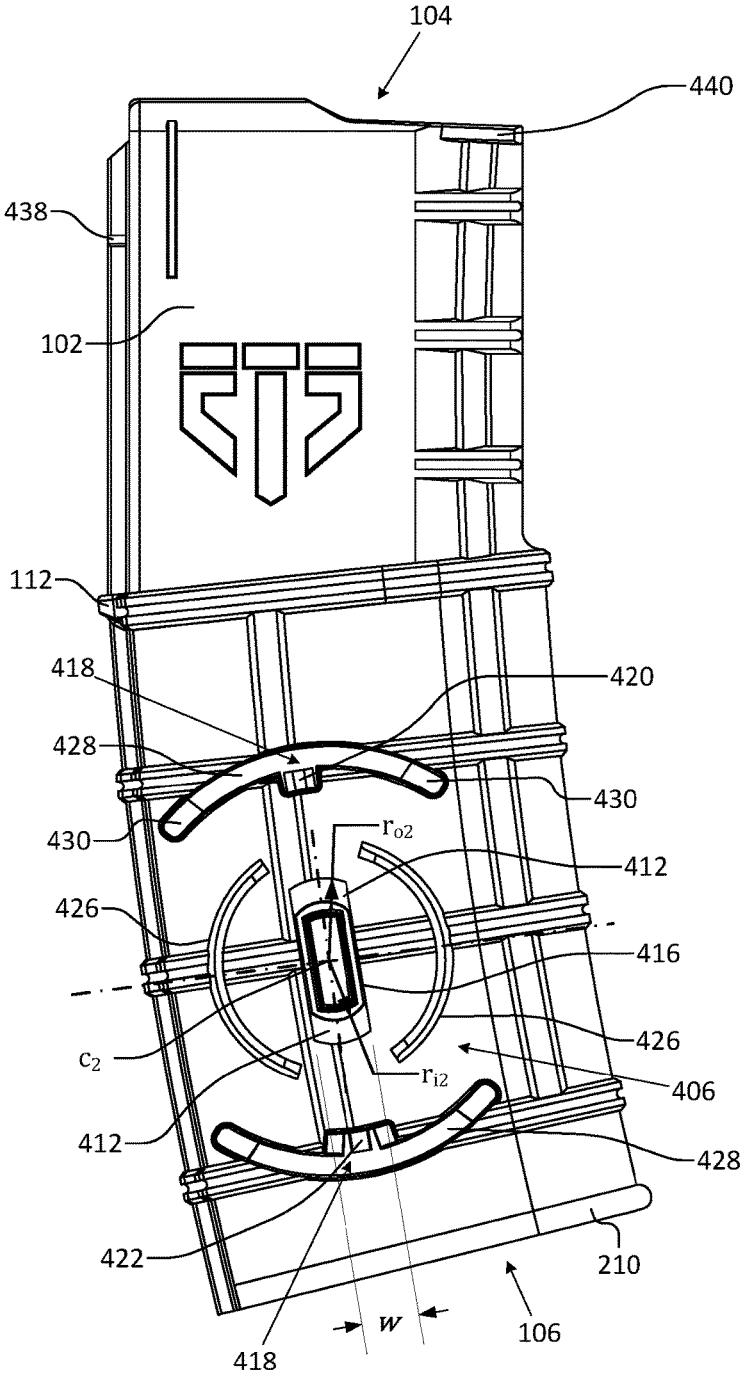
FIG. 4B is a right side elevation view illustrating aspects of the housing of the magazine depicted in FIG. 1.
Figure 4C:
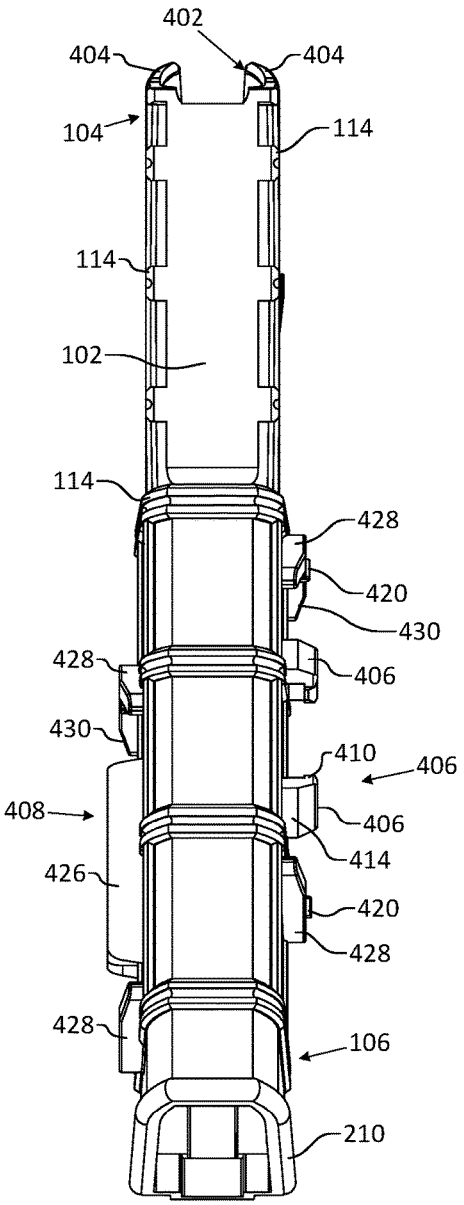
FIG. 4C is a front elevation view illustrating aspects of the housing of the magazine depicted in FIG. 1.
Figure 4D:
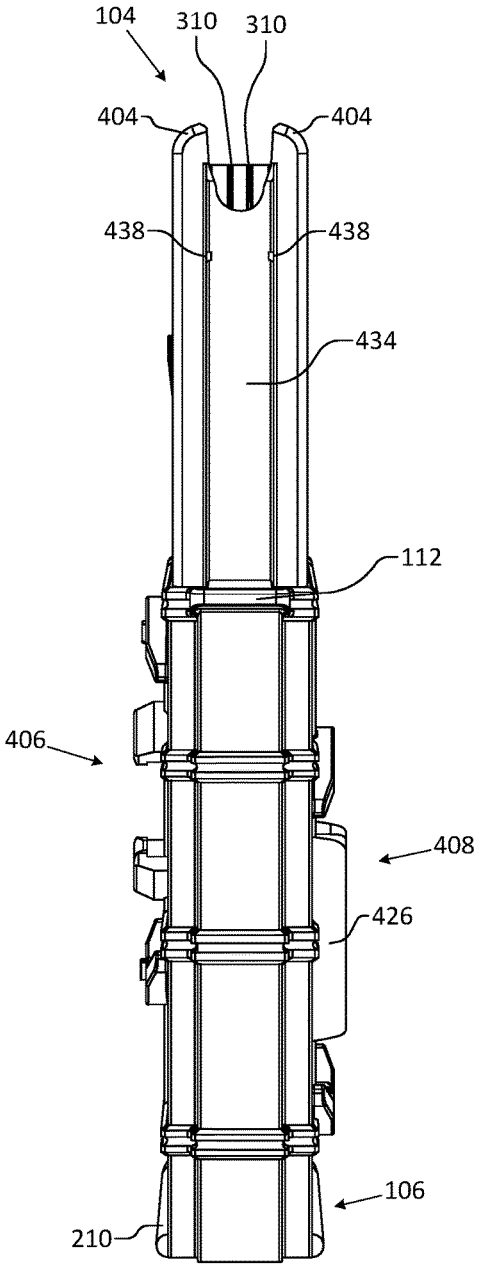
FIG. 4D is a rear elevation view illustrating aspects of the housing of the magazine depicted in FIG. 1.
Figure 4E:
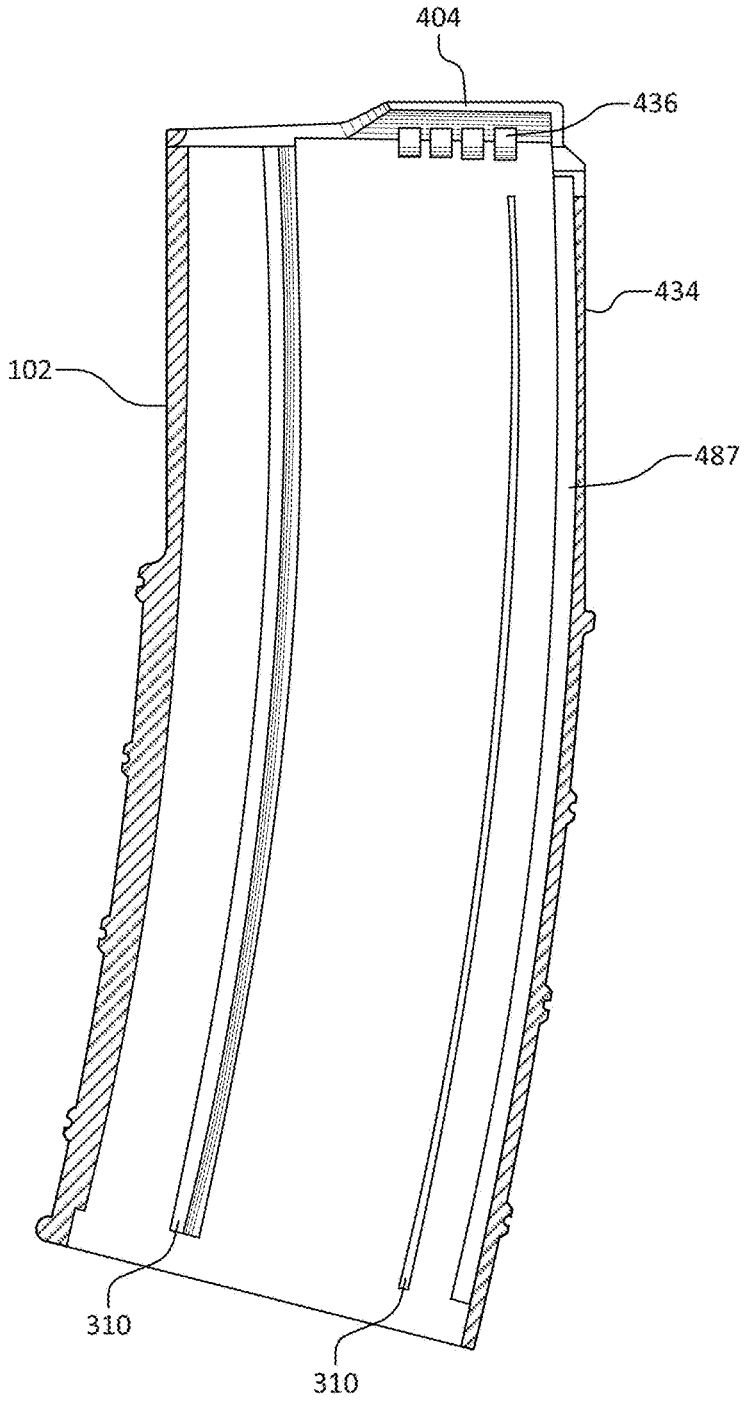
FIG. 4E is a sectional left side elevation view taken along section E-E of FIG. 4A illustrating the aspects of the housing interior.

FIG. 4E is a sectional left side elevation view taken along section E-E of FIG. 4A illustrating the aspects of the housing interior. Embodiments of the housing 102 include one or more internal ribs 310 that smoothly guide the follower 206 as it moves through the housing 102. One side wall of the spine 434 that forms a bounded track 487 guiding the movement of the follower 206 is seen along the rear of the housing 102. The internal ribs 310 terminate before reaching the floor end 106 of the housing 102. As previously mentioned, the bottom edges of the internal ribs 310 define the upper limit of travel for the floor insert 204.

PPSU and other unreinforced/translucent polymers (e.g., PC and PEEK) generally have a lower flexural modulus (i.e., it is less rigid) than the reinforced polymers (e.g., LFT PP) commonly used in conventional AR magazines, which was found by the present inventors to be a drawback for use in AR magazines. In an AR magazine, the dimensional specifications required to fit the magazine well and properly feed ammunition effectively limit the wall and feed lip thickness. Under the dimensional constraints, the PPSU feed lips were not thick enough to have sufficient rigidity to withstand the recoil without flexing. This resulted in a misalignment between the topmost cartridge and the feed ramp and made feeding unreliable. The dimensional constrains coupled with the increased flex provided a significant challenge in designing a translucent PPSU magazine, particularly without moving to hybrid solutions, which increase the cost and complexity of manufacturing and introduce other issues.

Conventional magazine design approaches focus on minimizing friction at the feed lips to allow ammunition to feed easily and quickly into the firearm, especially when designing magazines for automatic weapons. As such, conventional wisdom suggests that inner surfaces of the feed lips should be smooth. It was surprising to the present inventors that adding a series of optional internal projections 436 proximate to the feed lips 404 would center the topmost cartridge within the PPSU magazine so it remained properly aligned with the feed ramp and solve the alignment problem without having an appreciable effect that interferes with actively feeding ammunition from the magazine 100.

At the same time, the internal projections 436 were also found to solve a different problem relating to the magazine coupling system. When magazines are coupled, each of the magazine is subjected to the forces (e.g., recoil) generated when firing the ammunition. Burst and fully-automatic weapon fire creates longer and sustained application of the forces, and the forces become more rhythmic. For the coupled magazine that is inserted into the magazine well, the cartridges are constrained by the firearm. However, the topmost cartridge in a coupled magazine residing outside of the firearm magazine well has a tendency to "walk" due to vibrations from firing the weapon and the compressive forces exerted by the spring. The end result is the topmost cartridge in the external coupled magazine moves forward and may protrude beyond the front edge of the magazine. A magazine with a protruding cartridge cannot be inserted into the magazine well. Accordingly, the protruding cartridge must be stripped off (i.e., manually ejected from the magazine) or properly reseated (i.e., pushed back into the magazine) before the magazine can be used. This wastes ammunition and/or eliminates the quick magazine changes associated with coupled magazines.

Adding small internal projections 436 on the interior of the housing 102 at the feed lips 404 slightly disrupts the generally smooth interior surface of the housing 102 enough to resist movement of the topmost cartridge in a coupled magazine 100 when the weapon is fired (i.e., adds friction) and hold the cartridge in place. The use of the internal projections 436 to increase friction to restrict movement of the topmost cartridge, which one would expect to reduce reliable ammunition feeding and/or fire rate further emphasizes why it is surprising that the internal projections 436 were an effective solution the feed ramp alignment problem.

Only a minimal amount of extension from the interior surface for the internal projections 436 to be effective. The amount of resistance to cartridge walking in coupled magazines may be varied by altering one or more factors including, but not limited to, the number, shape, position, and height of the internal projections. For example, the illustrated embodiment depicts four internal projections 436 with partially sloped or curved faces that make contact with the cartridge, but suitable can be obtained with more or fewer internal projections 436 and/or different face shapes (e.g., flat faces).

Figure 8:
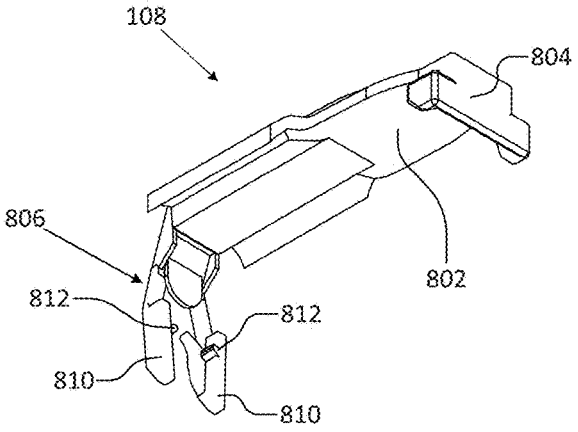
FIG. 8 is a perspective view illustrating aspects of the storage cover for the magazine depicted in FIG. 1.

FIG. 8 illustrates aspects of the storage cover for the embodiment of the magazine depicted in FIG. 1. The cover 108 minimizes or prevents dirt, dust and other forms of debris from entering the housing while the magazine 100 is being stored or transported. The cover 108 includes a lid 802 that covers the feed end opening 402. The front end of the cover 108 is securable to the magazine by a front arm 804 that engages a projection 440 proximate to the top of the housing 100. The rear end of the cover 108 includes a clip 806 that engages the spine 434 on the rear side of the housing 100. In the illustrated embodiment, the clip 806 is a spring clip including two separate arms 810 that engage opposite sides of the spine 434. In various implementations, one or both arms 810 include a tab 812 configured to engage the corresponding slots 438 on the spine 434. The cover 108 is secured to the housing 102 when the front arm 804 engages the front projection 440 and the tab 812 of the clip 806 are positioned in engagement with the slots 438. The cover is removed from the housing 102 by spreading the free ends of the arms 810 (e.g., by sliding the user's thumb vertically up the spine between the arms) to disengage the tabs 812 from the slots 438. The ease with which the clip 806 disengages from the spine 434 is variable based on factors such as the mechanical properties of the material (e.g., elasticity), the arm configuration, the arm dimensions, and the number of tabs 812. For example, with a less pliable material, one tab 810 may be sufficient to secure the cover 108 to the housing 100, while two tabs 810 may be overly difficult to quickly dislodge using one hand.

Figure 9:
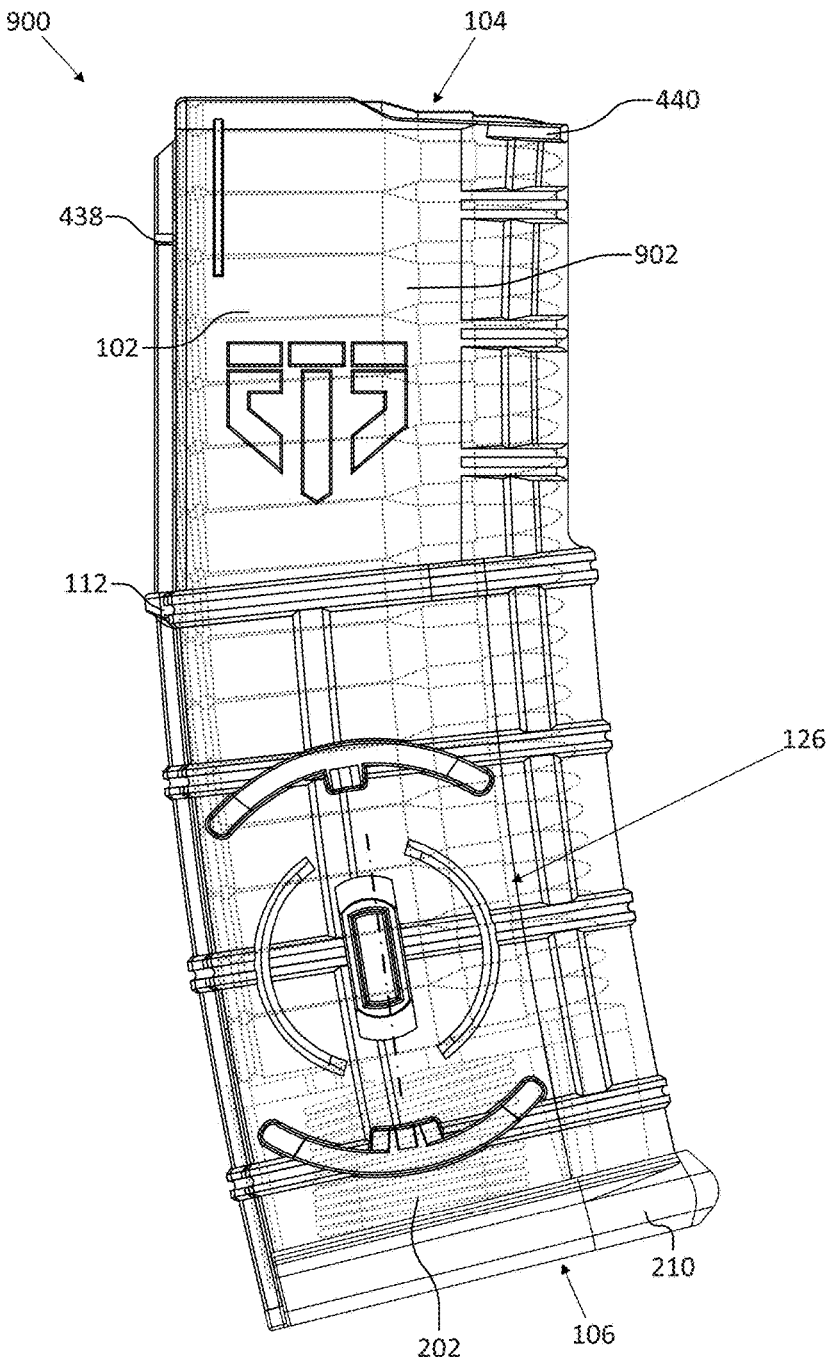
FIG. 9 is a right side view of a translucent magazine fabricated from PPSU according to the present invention showing that the ammunition rounds are visible through the body of the magazine.

FIG. 9 illustrates a magazine with a translucent body fabricated from a translucent PPSU. An often desirable, but optional, aspect of the magazine or other firearm component fabricated from PPSU is optical transparency, which allows users to visually inspect the magazine contents. The translucent magazine 900 allows users quickly determine useful information, such as, how many rounds and what type of ammunition 902 is loaded into the magazine. The translucent magazine also allows users to evaluate the operational condition of the magazine by looking for issues such as a broken spring, mud or other debris in the magazine, and the like, without requiring disassembly of the magazine. Beyond the convenience and added safety that translucent magazines to firearm owners, in general, being able to rapidly ascertain such information through visual inspection is extremely beneficial during hostile encounters (e.g., military or law enforcement operations). The benefits of fabricating other translucent firearm components vary with the type of component. For example, translucent lower receivers and firearm bodies/frames allow opportunities to observe the processes that occur when firing the weapon. A translucent stock with internal storage allows a user to visually determine the storage contents.

The dimensional stability offered by PPSU is suitable for mass producing magazines and other firearm components using a standard manufacturing process, such as injection molding, that are within the, often, strict tolerances on dimensional specifications. For example, some critical dimensions of AR ammunition magazines cannot vary by more than 0.076 mm (0.003 in) for proper operation.

Reinforcement of thermoplastic polymers with other materials, such as glass or carbon fibers, tends to reduce or substantially interfere with translucence. Accordingly, translucent polymers are generally unreinforced, and conventional translucent polymer magazines have sacrificed durability and/or reliability in favor of translucence compared to opaque/colored magazines. Among other weaknesses, conventional translucent polymer magazines are recognized as being highly susceptible to damage from many common chemicals and more prone to the effects of compared to their opaque counterparts.

The optical properties of PPSU relevant to fabrication of translucent firearm components are a refractive index ranging between approximately 1.655 at a thickness of 700 mm (27.6 in) and approximately 1.76 at a thickness of 560 mm (22.0 in) for wavelengths of approximately 2.00 nm and a light transmission of at least approximately 3.0% for wavelengths of about 300 nm, at least approximately 30% for wavelengths of about 350 nm, at least approximately 60% for wavelengths of about 400 nm, at least approximately 80% for wavelengths of about 500 nm, and at least approximately 85% for wavelengths of about 600 nm. Aspects of the transparent PPSU magazine can range from substantially fully optically transparent (i.e., clear) to partially optically transparent (e.g., tinted). Other PPSU formulations not meeting the optical properties listed above (e.g., a reinforced PPSU or one with a colored additive) may be used when producing opaque firearm components.

The present inventors evaluated the suitability of the PPSU AR magazines relative to other AR magazines including Government Issue aluminum magazines, conventional polymer magazines from different manufacturers representing the state of the art in polymer magazines, and hybrid polymer and steel magazines having a PEEK body and insert-molded carbon steel feed lips. The tests included destructive tests, such as drop tests of fully-loaded magazines, as well as tests intended to evaluate the reliability and durability of the magazines. Conventional AR magazines are routinely tested by manufacturers, firearm industry publications, and firearm enthusiasts and the results published. Accordingly, in the interest of efficiency, the present inventors did not personally test the conventional AR magazines in areas where such magazines are known to have good performance.

Beyond determining whether the PPSU AR magazines at least met the required military specifications, the primary focus of the tests performed by the present inventors was to evaluate the PPSU AR magazine in areas where the performance of conventional AR magazines suffers. Generally, LFTs used in many conventional polymer magazines are recognized as having good resistance to chemicals, creep, and high temperatures. Where conventional polymer magazines suffer typically suffer are in the areas of cold resistance, overall impact resistance, UV resistance (if not properly formulated).

To test the durability of the PPSU magazines, fully-loaded magazines were repeatedly dropped from a height of 1.83 m (6 ft) onto a concrete surface until the magazine exhibited mechanical failure (e.g., splitting or cracking). Cosmetic damage (e.g., scuffs, scrapes, or gouges) was not considered to be mechanical failure. AR magazines are more likely to fail when a fully-loaded magazine is dropped onto its feed lips than when dropped on any other side. Accordingly, the first round of drop tests were conducted by dropping the fully-loaded magazines onto their feed lips.

All of the AR magazines tested were 30 round magazines including a Government Issue aluminum magazine, conventional polymer magazines from different manufacturers representing the state of the art in polymer magazines, a hybrid polymer and steel magazine having a PEEK body and insert-molded carbon steel feed lips, and the PPSU magazine.

The GI aluminum magazine and all but one conventional polymer magazine failed on the first drop. However, the surviving conventional polymer magazine broke on the second drop. After surviving six drops without failure, the hybrid magazine was dropped from a height of 6.1 m (20 ft). On the first drop from 6.1 m (20 ft), one of the steel feed lips on the hybrid magazine (I) bent so badly it would not feed the firearm. In comparison, the PPSU magazine survived 20 drops without failure before moving on to the drop test from 6.1 m (20 ft).

AR magazines are also susceptible to being rendered useless when crushed, which can deform the magazine and restrict movement of the follower. Four representative magazines, including the GI aluminum magazine, a LFT (PP) magazine, the hybrid PEEK/steel magazine, and the PPSU magazine were crush tested by placing each magazine on a concrete surface and driving over it with a truck having a gross weight vehicle rating (GWVR) of 3629 kg (8,000 lbs). The truck was stopped while the wheel was on top of the magazine. The GI aluminum magazine broke at the welds and came completely apart. The hybrid magazine was crushed by the truck and rendered non-functional as the follower could no longer move within the housing. Other than minor scuffing, the LFT (PP) magazine and the PPSU magazine were not damaged.

The drastic difference in durability, as evidenced by the results of drop and crush tests, is attributable to the properties of the PPSU. The properties of PPSU that provide the impact resistance and elasticity to handle being repeatedly dropped while fully-loaded with ammunition onto concrete from heights in excess of 1.83 m (6 ft) without exhibiting permanent damage, such as splitting and cracking, include a tensile strength of approximately 74 MPa (10,700 psi) at 5 mm/min (0.20 in/min), a tensile stress ranging between approximately 30 MPa (4,350 psi) at 160° C. (320° F.) and approximately 70 MPa (10,200 psi) at 23° C. (73.4° F.), a yield strength ranging between approximately 45 MPa (6,530 psi) at 140° C. (284° F.) and approximately 75 MPa (10,900 psi) at 20.0° C. (68.0° F.), an elongation (tensile strain) at yield of 7.8%, a Charpy notched impact strength of approximately 75 kJ/m$^2$ (35.7 ft-lb/in$^2$) at 23° C. (73.4° F.), an Izod notched impact strength of approximately 55 kJ/m$^2$ (26.2 ft-lb/in$^2$) at 23° C. (73.4° F.), a modulus of elasticity ranging between approximately 1.60 GPa (232 ksi) at 100° C. (284° F.) and approximately 2.25 GPa (326 ksi) at 20° C. (68° F.), and a tensile modulus of at least approximately 2.27 GPA (329 ksi). Other properties contributing to the impact resistance include a shear modulus of approximately 0.200 GPA (29.0 ksi) at 225° C. (437° F.), approximately 0.775 GPa (112 ksi) at 100° C. (212° F.), and approximately 0.800 GPa (116 ksi) at 50° C. (122° F.).

The PPSU magazine body is sufficiently hard to resist scratches, wear, and other types of degradation that affects performance or impairs the optical transparency of the magazine. In various embodiments, the PPSU has a ball indentation hardness of approximately 124 MPa (18,000 psi). In testing, the single magazine used to fire over 8,000 rounds of ammunition showed no discernable wear on the feed lip that led to feed issues.

For AR magazines, creep is a significant concern because the design requires the feed lips to bear the tension of the applied by spring. The greatest tension occurs when the magazine is fully-loaded. When materials prone to creep are used, the tension results in displacement (i.e., spreading) of the feed lips. Spreading of the feed lips may render a magazine non-functional for a variety of reasons, such as an inability to securely retain ammunition rounds in the magazine and failure to properly feed ammunition to the firearm. Most non-reinforced polymers, especially clear plastics, do very poorly with regards to creep because of their non-crystalline structures. In ongoing creep testing by the present inventors, fully-loaded PPSU magazines have been stored at room temp, about 21° C. (70° F.), for over a year without even 0.0254 cm (0.001 in) of creep movement (i.e., displacement). When heated to 95° C. (203° F.), PPSU has a creep strength of approximately 37.0 MPa (5,370 psi) after 10 hours and approximately 30.0 MPa (4,350 psi) after 10,000 hours.

Resistance to creep and wear is an important characteristic for the integrated coupler, which must remain tight in order to work. The integrated coupler also presents unique demands of handling the stresses associated coupling two fully-loaded magazines together. In testing, two fully-loaded PPSU magazines were dropped on their feed lips onto concrete from a height of 1.83 m (6 ft) and suffered no mechanical failure of either the magazine or the integrated coupler.

The PPSU magazine is sufficiently thermal stable to withstand unusually high temperatures without becoming soft or experiencing deformation while placed under tension by the spring. By way of example, extreme temperatures may be encountered by magazines stored in containers heated by direct sunlight in desert areas, including vehicles trunks. The properties providing the thermal stability include a coefficient of thermal expansion of approximately 55.0 μm/m-° C. (30.6 pin/in-° F.) over temperatures ranging from approximately 25° C. (77° F.) to 80° C. (176° F.) and approximately 62.0 μm/m-° C. (34.4 μin/in-° F.) over temperatures ranging from approximately 140° C. (284° F.) to 180° C. (356° F.), a deflection temperature of approximately 212° C. (414° F.) at 0.46 MPa (66 psi) and approximately 196° C. (385° F.) at 1.8 MPa (264 psi), and a glass transition temperature, Tg of approximately 220° C. (428° F.).

The PPSU magazine was subjected to thermal testing. The thermal tests included heating a fully-loaded magazine to a temperature of 82° C. (180° F.) for 168 hours. The heat did not cause the PPSU magazine to become soft and unable to retain ammunition rounds. Further, the PPSU magazine did not show signs of accelerated creep due to the exposure to the high temperature. After being removed from the oven, the PPSU magazine was drop tested while at the elevated temperature. As before, dropping the PPSU magazine on its feed lips onto a concrete surface from a height of 1.83 m (6 ft) did not result in mechanical failure.

The thermal tests also included cooling the PPSU magazine to a temperature of −51° C. (−60° F.) for 24 hours. After being removed from the cold chamber, the PPSU magazine was drop tested while at the reduced temperature. Once again, dropping the PPSU magazine on its feed lips onto a concrete surface from a height of 1.83 m (6 ft) did not result in mechanical failure. Ammunition rounds were then successfully fired from the PPSU magazine, which established that the material was capable of withstanding recoil forces at low temperatures.

The PPSU magazine body is sufficiently resistant to large thermal variations over a large number of thermal cycles. More specifically, the PPSU magazine retains at least approximately 90% of its mechanical properties after being subjected to at least approximately 1,000 cycles of being heated from temperatures below approximately 49° C. (120° F.) to temperatures of over approximately 121° C. (250° F.).

Further, the present inventors have fired over 8,000 rounds of ammunition from a single PPSU magazine. This represents over 250 cycles of heating the PPSU magazine up from ambient temperature to the firearm operating temperature of at least approximately. 82° C. (180° F.) followed by a return to ambient temperature with no observable deleterious effects on the operation of the magazine.

Chemical resistance is a concern with many polymers. The PPSU magazine body is resistant to a wide range of chemicals to which a military grade firearm component is subject to being exposed during service. Examples of such chemicals include N,N-Diethyl-meta-toluamide (DEET), water, firearm cleaning solvents, aliphatic hydrocarbons (e.g., gasoline, kerosene, petroleum, diesel fuel, jet fuel, hydraulic fluid, motor oil, brake fluid, transmission fluid, anti-freeze, de-ice fluid, ethanol), acids (e.g., concentrated hydrochloric acid), and chlorine. DEET is widely used as insect repellent by the U.S. military and exposure to DEET has been shown to be particularly detrimental to many polymers, especially translucent thermoplastics. Tests of one variant of the hybrid magazine have shown an extreme sensitivity to DEET resulting in catastrophic failure within eight (8) of being sprayed with 100% DEET.

In tests conducted by the present inventors, the PPSU magazine exhibited no damage even after being soaked in 99.6% DEET for 504 hours. Similarly, the PPSU magazines were unaffected by soaking for 24 hours in various chemicals commonly used for cleaning firearms.

The PPSU magazine body is sufficiently non-hygroscopic to avoid swelling in size to a point that prevents the magazine from experiencing fitment issues. More specifically, prolonged exposure to water, including moisture in the air, does not cause the PPSU magazine body to swell and prevent it from being properly received and seated within or removed from the magazine well of the firearm or to experience clearance issues that prevent proper feeding of ammunition rounds into the firearm.

The PPSU at a thickness of 2 mm (0.0787 in) has a water absorption saturation of no more than approximately 1.2% when immersed for approximately 500 hours and a moisture absorption at equilibrium, $M_{eq}$, of less than approximately 0.80% and preferably less than approximately 0.60% at a temperature of approximately 23° C. (73° F.) and relative humidity of approximately 50%. By way of comparison, several of the conventional polymer magazines, particularly those made of nylon, absorbed 4 to 5 times more water than the PPSU magazine. Because water acts as a plasticizer on nylon, it softened the conventional polymer magazines made from nylon. Additionally, the amount of water that was absorbed by the conventional polymer magazines made from nylon caused some of them to swell to the point that the magazine would not drop free of the magazine well when released. Such softening and dimensional instability is undesirable in magazines and other firearm components.

The PPSU magazine is also sufficiently resistant to prolonged exposure to ultraviolet (UV) radiation (e.g., sunlight) without becoming brittle, or otherwise degraded. UV stability tests exposed the PPSU magazine to much higher levels of UV radiation than it would see outside. After exposure to the UV radiation for 504 hours, the PPSU magazine was subjected to drop and crush tests to ensure it had not become brittle. Yet again, dropping the PPSU magazine on its feed lips onto a concrete surface from a height of 1.83 m (6 ft) and running over it with the truck did not result in mechanical failure. The present inventors observed no discernable difference between the durability of the PPSU magazines after extended, elevated UV exposure and new PPSU magazines.

The depiction of the AR magazine as a representative firearm component is not intended to limit the types of firearm components that may be produced using the PPSU described herein. More specifically, the PPSU described herein is suitable for use in fabricating other firearm components such as, but not limited to, stocks, grips, firearm bodies, slides, uppers, and lowers. Further, while the foregoing discussion refers to an PPSU, a PPSU reinforced with at least one other material, such as glass and/or carbon fibers, may be used to further improve the performance of the firearm component, when translucent firearm components. More specifically, the PPSU may be formulated with up to about 10 wt % of one or more additives such as, without limitation, internal mold release agents, heat stabilizers, anti-static agents, colorants, impact modifiers, and UV stabilizers.

The above specification, examples, and data provide a complete description of the manufacture and use of the composition of the invention. Since many implementations of the invention can be made without departing from the spirit and scope of the invention, the invention resides in the claims hereinafter appended.

What is claimed is:

1. A polymer magazine for a magazine fed firearm, the polymer magazine comprising:

a housing having a front, a back, a left side, and a right side, the housing defining an open bottom end and an open top end, the housing being fabricated from a polyphenylsulfone having a Charpy notched impact strength of at least approximately 75 kJ/m$^2$ (35.7 ft-lb/in$^2$);

a floor plate connected to the housing;

a follower disposed within the housing; and a spring operatively positioned within the housing between the floor plate and the follower, the spring biasing the follower toward the housing top opening.

2. The polymer magazine of claim 1 wherein the housing is fabricated from an unreinforced polyphenylsulfone.

3. The polymer magazine of claim 1 wherein the housing is translucent.

4. The polymer magazine of claim 3 wherein the housing is fabricated from a polyphenylsulfone having a refractive index ranging between approximately 1.655 at a thickness of 700 mm (27.6 in) and approximately 1.76 at a thickness of 560 mm (22.0 in) for wavelengths of approximately 2.00 nm.

5. The polymer magazine of claim 3 wherein the housing is fabricated from a polyphenylsulfone having a light transmission of at least approximately 3.0% for wavelengths of about 300 nm, at least approximately 30% for wavelengths of about 350 nm, at least approximately 60% for wavelengths of about 400 nm, at least approximately 80% for wavelengths of about 500 nm, and at least approximately 85% for wavelengths of about 600 nm.

6. The polymer magazine of claim 1 wherein the housing is fabricated from a polyphenylsulfone having a creep strength of approximately 30 MPa (4,350 psi) after 10,000 hours.

7. The polymer magazine of claim 1 wherein the housing is fabricated from a polyphenylsulfone having a moisture absorption of no more than approximately 0.8%.

8. The polymer magazine of claim 1 wherein the housing is fabricated from a polyphenylsulfone having a moisture absorption saturation of no more than approximately 1.2%.

9. The polymer magazine of claim 1 wherein the housing is fabricated from a polyphenylsulfone having a deflection temperature of approximately 196° C. (385° F.) at 1.8 MPa (264 psi).

10. The polymer magazine of claim 1 wherein the housing is fabricated from a polyphenylsulfone having a glass transition temperature of approximately 220° C. (428° F.).

11. The polymer magazine of claim 1 wherein the housing is fabricated from a polyphenylsulfone having a tensile strength of approximately 74 MPa (10,700 psi) and a modulus of elasticity ranging between approximately 1.60 GPa (232 ksi) at 100° C. (284° F.) and approximately 2.25 GPa (326 ksi) at 20° C. (68° F.).

12. The polymer magazine of claim 1 wherein the housing is fabricated from a polyphenylsulfone having a tensile modulus of at least approximately 2.27 GPA (329 ksi).

13. The polymer magazine of claim 1 wherein the housing is fabricated from a polyphenylsulfone having a yield strength ranging between approximately 45 MPa (6,530 psi) at 140° C. (284° F.) and approximately 75 MPa (10,900 psi) at 20.0° C. (68.0° F.).

14. The polymer magazine of claim 1 wherein the housing further comprises an integrated coupling system having complimentary fasteners for securely connecting the polymer magazine to another polymer magazine with the integrated coupling system by manual manipulation of the orientations of the magazines bearing the complimentary fasteners relative to each other.

15. A polymer magazine for a magazine fed firearm, the polymer magazine comprising:

a housing having a front, a back, a left side, and a right side, the housing defining an open bottom end and an open top end, the housing being fabricated from a translucent polyphenylsulfone having a Charpy notched impact strength of at least approximately 75 kJ/m2 (35.7 ft-lb/in2);

a floor plate connected to the housing;

a follower disposed within the housing; and a spring operatively positioned within the housing between the floor plate and the follower, the spring biasing the follower toward the housing top opening.

16. The polymer magazine of claim 15 wherein the housing is fabricated from a polyphenylsulfone also having a creep strength of approximately 30 MPa (4,350 psi) after 10,000 hours and a tensile strength of approximately 74 MPa (10,700 psi).

17. The polymer magazine of claim 16 wherein the housing is fabricated from a polyphenylsulfone also having an elongation at yield of approximately 7.8%.

18. The polymer magazine of claim 17 wherein the housing is fabricated from a polyphenylsulfone also having an Izod notched impact strength of at least approximately 55 kJ/m2 (26.2 ft-lb/in2).

19. A polymer magazine for a magazine fed firearm, the polymer magazine comprising:

a housing having a front, a back, a left side, and a right side, the housing defining an open bottom end and an open top end, the housing being fabricated from a polyphenylsulfone having an Izod notched impact strength of at least approximately 55 kJ/m2 (26.2 ft-lb/in2);

a floor plate connected to the housing;

a follower disposed within the housing; and a spring operatively positioned within the housing between the floor plate and the follower, the spring biasing the follower toward the housing top opening.

20. The polymer magazine of claim 19 wherein the housing is fabricated from a polyphenylsulfone also having a creep strength of approximately 30 MPa (4,350 psi) after 10,000 hours and a tensile strength of approximately 74 MPa (10,700 psi).

21. The polymer magazine of claim 20 wherein the housing is fabricated from a polyphenylsulfone also having an elongation at yield of approximately 7.8%.

22. The polymer magazine of claim 21 wherein the housing is fabricated from a polyphenylsulfone also having a Charpy notched impact strength of at least approximately 75 kj/m2 (35.7 ft-lb/in2).

23. The polymer magazine of claim 1 wherein the housing is fabricated from a polyphenylsulfone also having an elongation at yield of approximately 7.8%.

24. The polymer magazine of claim 23 wherein the housing is fabricated from a polyphenylsulfone also having a creep strength of approximately 30 MPa (4,350 psi) after 10,000 hours and a tensile strength of approximately 74 MPa (10,700 psi).

25. The polymer magazine of claim 1 wherein the housing is fabricated from a polyphenylsulfone also having an Izod notched impact strength of at least approximately 55 kJ/m2 (26.2 ft-lb/in2).

* * * * *